United States Patent [19]

Bobo et al.

[11] 4,222,230

[45] Sep. 16, 1980

[54] COMBUSTOR DOME ASSEMBLY

[75] Inventors: Melvin Bobo, Cincinnati, Ohio; Thomas L. DuBell, Lake Park, Fla.

[73] Assignee: General Electric Company, Cincinnati, Ohio

[21] Appl. No.: 933,221

[22] Filed: Aug. 14, 1978

[51] Int. Cl.[3] ..... F02C 7/04

[52] U.S. Cl. ..... 60/39.36; 60/756; 60/757

[58] Field of Search ..... 60/39.66, 39.69, 39.65, 60/39.32, 39.36

[56] References Cited

U.S. PATENT DOCUMENTS

| | | | |
|---|---|---|---|
| 3,369,363 | 2/1968 | Campbell | 60/39.65 |
| 3,656,298 | 4/1972 | Wade | 60/39.65 |
| 3,854,285 | 12/1974 | Stenger et al. | 60/39.66 |
| 3,972,182 | 8/1976 | Salvi | 60/39.32 |
| 3,990,232 | 11/1976 | Campbell | 60/39.66 |

*Primary Examiner*—Carlton R. Croyle
*Assistant Examiner*—Edward Look
*Attorney, Agent, or Firm*—Derek P. Lawrence

[57] ABSTRACT

An improved cooling arrangement is provided for cooling a portion of a combustor dome assembly of a gas turbine engine. The improvement is comprised of an annular dome plate having a generally V-shaped cross section and including one or more circumferentially spaced apart, generally radial cooling slots within a surface which is exposed to the combustion zone.

3 Claims, 2 Drawing Figures

COMBUSTOR DOME ASSEMBLY

BACKGROUND OF THE INVENTION

1. Field of the Invention

This invention relates generally to a gas turbine engine combustor assembly and, more particularly, to an improved cooling apparatus for a combustor dome assembly.

2. Description of the Prior Art

Combustion, in a gas turbine engine, occurs within a combustion zone defined by a pair of combustor liners extending longitudinally downstream from a dome assembly. Air, introduced into the dome assembly, is mixed with fuel, sprayed into the combustion zone and ignited. Since the dome assembly is immediately adjacent to the combustion zone, it is subject to the intense heat produced by the combustion process. As a result, high temperatures can occur in the dome assembly which, if allowed to remain unattended, can cause dome deterioration and limit the operating life of the dome assembly.

To protect the dome assembly from the intense heat of combustion, it is known in the prior art to use a portion of the air introduced into the dome assembly to cool various sections of the dome. It is common practice to utilize louvered joints or cooling holes in the dome to bleed a portion of the air across various sections of the dome to provide a film of cool air which forms a barrier against the heat generated by the combustion process. While many different arrangements of louvers and cooling holes have been employed in prior art combustors, none have been found to be entirely satisfactory.

SUMMARY OF THE INVENTION

It is, therefore, an object of the present invention to provide a combustor dome assembly which includes an improved cooling arrangement for protecting the dome from the effects of the hot combustion gases and prolonging the life of the dome.

It is another object of the present invention to relieve the stresses caused by unmatched thermal displacement of the combustor dome assembly components.

Briefly stated, these objects, as well as additional objects and advantages which will become apparent from the following specification and the appended drawings and claims, are accomplished by the present invention which, in one form, provides a combustor dome assembly including an annular dome plate having a generally V-shaped cross section. First and second legs extend upstream from the apex of the V-shaped dome with the first leg being generally parallel to and in abutting engagement with one of a pair of combustor liners. The second leg extends upstream from the apex at an acute angle with respect to the first leg to form with the apex a surface which is exposed to the combustion zone. The dome plate includes one or more circumferentially spaced apart slots therethrough, extending generally radially through the first leg, the apex, and second leg. The slots may be located so as to intersect with a plurality of openings in an annular dome panel attached to the upstream end of the second leg.

DESCRIPTION OF THE PREFERRED EMBODIMENT

Figure 1:
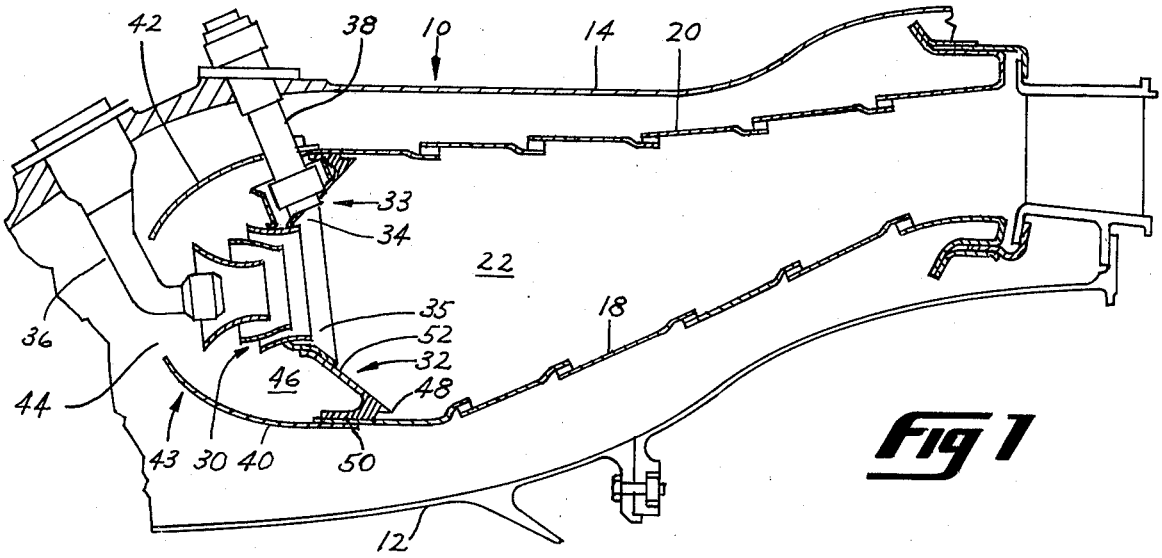
FIG. 1 is a partial, cross-sectional view of the combustion apparatus of a gas turbine engine including the improved cooling arrangement of the present invention.

Referring now to the drawings, attention is directed to FIG. 1 wherein a portion of a gas turbine engine combustor assembly is illustrated in cross section and is designated generally by the numeral 10. The combustor assembly 10 includes axially and circumferentially extending inner and outer combustor casings 12 and 14, respectively, which cooperate to define an annular flowpath downstream of a compressor (not shown). A pair of circumferentially and axially extending combustor liners 18 and 20 are positioned between the inner casing 12 and the outer casing 14 and are radially spaced apart in such a manner as to form an annular combustion zone 22. A combustor dome assembly shown generally as 30 is mounted between and cooperates with the upstream end of the liners 18 and 20 to form the upstream end of the combustion zone 22.

The combustor dome assembly 30 includes a pair of annular dome plates 32 and 33 and an annular dome panel 34 which receives a plurality of fuel/air carbureting devices 35. A fuel nozzle 36 is arranged so as to inject fuel into the upstream end of carbureting device 35 wherein the fuel is mixed with air and ejected into the combustion zone 22. An igniter plug 38 protrudes into the combustor 10 through casing 14 and outer liner 20 and is positioned so that its ignition tip is immediately adjacent to the downstream end of the carbureting device 35. The plug 38 ignites the fuel/air mixture flowing downstream of the carbureting device 35, thereby producing combustion.

A pair of members 40 and 42 forming a cowl, shown generally as 43, are mounted on the combustor liners 18 and 20, respectively, and cooperate to form an inlet 44 for the entry of combustion air into an inlet plenum 46. A portion of the combustion air entering the plenum 46 through the inlet 44 is directed into the carbureting device 35 and is then mixed with fuel as earlier herein set forth. The remaining portion of the air entering inlet 44 may be utilized for cooling the combustor liners 18 and 20 and for other cooling purposes which will hereinafter be described.

Referring to the figures, it is observed that the annular dome plates 32 and 33 are constantly exposed on their downstream side to the combustion zone 22 and, hence, to the heat released during the combustion process. The upstream side of the annular dome plates 32 and 33 are constantly exposed to the cooling air within the plenum 46. The dome plates are thus subjected to undesirable thermal stresses caused by the unmatched thermal displacement between the dome plates and the adjacent mating components as well as by unequal temperature gradients within the dome plates themselves. These stresses may lead to low cycle fatigue cracks in the prior art dome plates, thereby necessitating a premature replacement of the dome assembly. The present invention acts as a means to relieve these stresses and to prolong the useful life of the combustor dome assembly.

In order to avoid unnecessary duplication, the following description is directed only toward dome plate 32. It should be understood, however, that this description is applicable in the same manner to dome plate 33. Annular dome plate 32 is of a generally V-shaped cross section having an apex portion 48 from which extends first and second leg portions 50 and 52, respectively. Apex portion 48 is disposed adjacent to combustor liner 18 with first leg 50 extending upstream from the apex portion 48, generally parallel to, and in abutting engagement with, combustor liner 18.

Figure 2:
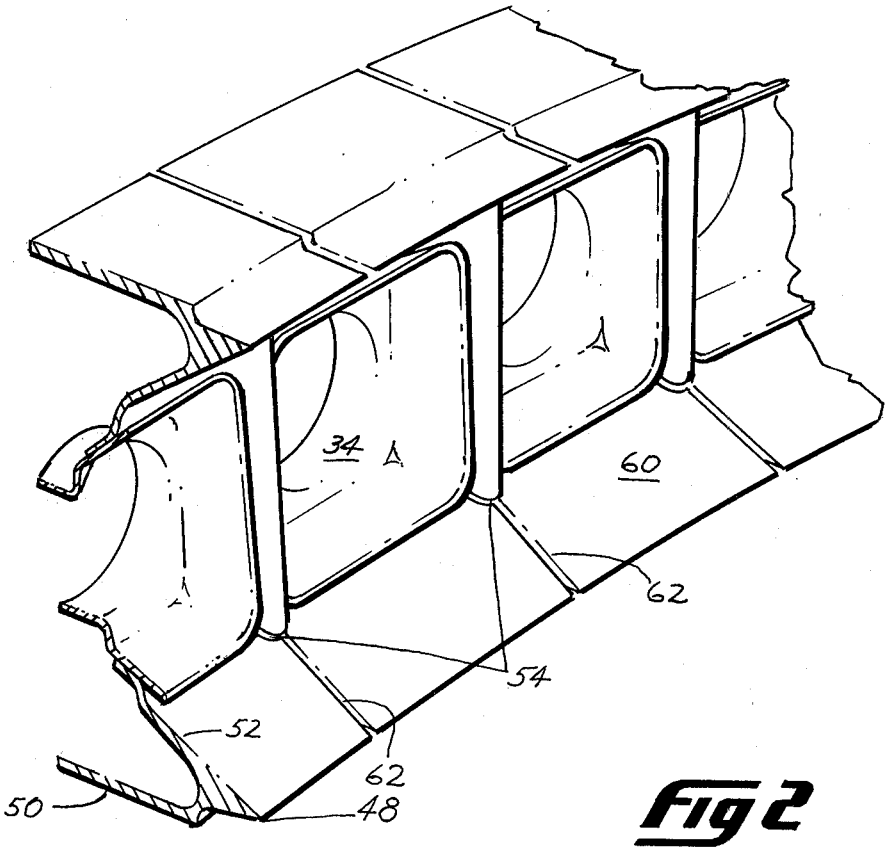
FIG. 2 is a partially cutaway prospective view of a portion of the apparatus of FIG. 1.

The second leg 52 also extends upstream from the apex portion 48 but at an acute angle from combustor liner 18. The second leg 52 and the apex portion 48 cooperate to form a surface 60 which is exposed to the combustion zone 22. As is best seen in FIG. 2, the annular dome panel 34 is attached to the upstream end of leg 52 and contains a plurality of arcuate openings 54 extending therethrough. The openings 54 establish fluid communication between the combustion zone 22 and the plenum 46. Cooling air located within the plenum 46 flows through the openings 54 and onto surface 60. A plurality of circumferentially spaced apart slots 62 extends generally radially through the dome plate 32, including the first leg 50, the apex portion 48 and the second leg 52 thereof and preferably intersects openings 54. In this manner, cooling air from the plenum 46 also flows through the slots 62 to cool the annular dome plate 32.

The use of slots 62 also serves to relieve the stresses imposed within the dome plate 32 by permitting unrestrained circumferential thermal growth of the dome plate structure. In addition, the cooling air which flows through the slots 62 tends to reduce the stresses resulting from unequal thermal gradients within the dome plate itself.

From the foregoing it can be seen that the present invention provides a combustor dome assembly which includes an improved cooling arrangement which protects the dome assembly from some of the effects of the heat of combustion and prolongs the life of the dome. It will be recognized by one skilled in the art that changes may be made to the above-described invention without departing from the inventive concepts thereof. It is to be understood therefore that the present invention is not limited to the above-disclosed embodiment but is intended to cover all modifications which are within the scope and spirit of the invention as set forth in the appended claims.

What is claimed is:

1. In a gas turbine engine combustor assembly including a pair of combustor liners radially spaced apart and forming a combustion zone therebetween, a dome assembly disposed between the liners and cooperating therewith to form an upstream end of the combustion zone, and an inlet cowl surrounding the dome assembly to define an inlet plenum upstream of the combustion zone, the improved dome assembly comprising:

an annular dome plate of generally V-shaped cross section including first and second legs extending from an apex portion thereof, said apex portion being disposed adjacent to one of the liners and downstream of said legs, said first leg extending upstream from said apex portion, generally parallel to and in abutting engagement with said one of the liners, said second leg extending upstream from said apex portion at an acute angle to said first leg and forming with said apex portion a surface exposed to the combustion zone, said dome plate including one or more circumferentially spaced apart slots extending generally radially through said first leg, said apex portion, and said second leg thereof.

2. In a gas turbine combustor assembly including a pair of combustor liners radially spaced apart and forming a combustion zone therebetween, a dome assembly disposed between the liners and cooperating therewith to form an upstream end of the combustion zone, and an inlet cowl surrounding the dome assembly to define an inlet plenum upstream of the combustion zone, the improved dome assembly comprising:

(a) an annular dome plate of generally V-shaped cross-section including first and second legs extending from an apex portion thereof, said apex portion being disposed adjacent to one of the liners and downstream of said legs, said first leg extending upstream from said apex portion generally parallel to and in abutting engagement with said one of the liners, said second leg extending upstream from said apex portion at an acute angle to said first leg and forming with said apex portion a surface exposed to the combustion zone, said dome plate including one or more circumferentially spaced apart slots extending generally radially through said first leg, said apex portion, and said second leg thereof; and (b) an annular dome panel attached to the upstream end of said second leg, having a plurality of openings intersected by said slots and extending through said dome panel for establishing fluid communication between said inlet plenum and said combustion zone, said openings being arranged to direct fluid flowing therethrough onto said surface.

3. The combustor assembly of claim 2, wherein said openings are arcuate.

* * * * *